US012252656B2

(12) United States Patent
Chakradhar et al.

(10) Patent No.: US 12,252,656 B2
(45) Date of Patent: Mar. 18, 2025

(54) ADDITIVE COMPOSITION FOR ENHANCED STABILITY OF OXYGENATED GASOLINE

(71) Applicant: INDIAN OIL CORPORATION LIMITED, Maharashtra (IN)

(72) Inventors: Maya Chakradhar, Faridabad (IN); Shanti Prakash, Faridabad (IN); Ajay Kumar Arora, Faridabad (IN); Vivekanand Kagdiyal, Faridabad (IN); Deepak Saxena, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 40 days.

(21) Appl. No.: 17/842,331

(22) Filed: Jun. 16, 2022

(65) Prior Publication Data

US 2022/0411709 A1 Dec. 29, 2022

(30) Foreign Application Priority Data

Jun. 24, 2021 (IN) ..... 202121028471

(51) Int. Cl.

| | |
|---|---|
| ***C10L 10/04*** | (2006.01) |
| ***C10L 1/02*** | (2006.01) |
| ***C10L 1/10*** | (2006.01) |
| ***C10L 10/14*** | (2006.01) |

(52) U.S. Cl.

CPC ..... *C10L 10/04* (2013.01); *C10L 1/023* (2013.01); *C10L 1/10* (2013.01); *C10L 10/14* (2013.01)

(58) Field of Classification Search

CPC ..... C10L 1/023; C10L 1/10; C10L 1/1824; C10L 1/1852; C10L 1/188; C10L 1/1881; C10L 10/04; C10L 10/14; C10L 2200/0423; C10L 2230/14; C10L 2270/023

See application file for complete search history.

(56) References Cited

U.S. PATENT DOCUMENTS

| | | | | |
|---|---|---|---|---|
| 4,336,032 | A | 6/1982 | Kupka et al. | |
| 9,447,342 | B2 | 9/2016 | Dietz et al. | |
| 2001/0015030 | A1* | 8/2001 | Wenzel | C10L 1/10 44/385 |
| 2012/0090226 | A1* | 4/2012 | Lamoureaux | C10L 1/02 44/452 |
| 2012/0311923 | A1* | 12/2012 | Rawat | C10L 1/14 436/6 |

FOREIGN PATENT DOCUMENTS

WO 2000036055 A1 6/2000

OTHER PUBLICATIONS

Amine et al., "Influence of ethyl acetate addition on phase stability and fuel characteristics of hydrous ethanol-gasoline blends" 2018.
Jiang et al. "Preparation and Application of Hydroxyacetic Acid Esters as Methanol-Gasoline Additives" 2013.
Babazadeh Shayan et al. "Effect of Oxygenates Blending with Gasoline to Improve Fuel Properties" 2012.

* cited by examiner

*Primary Examiner* — Latosha Hines

(74) *Attorney, Agent, or Firm* — Maschoff Brennan

(57) ABSTRACT

The present invention discloses additive package comprising a mixture of (a) 6-10% by weight of fatty acid (b) 7-15% by weight of alkoxy ether and (c) 60-85% by weight of linear or branched chain monohydroxylated aliphatic saturated alcohol (C2-C8) for improving stability of mixtures of methanol-gasoline, ethanol-gasoline blends containing at least 5-15% by volume of short chain alkanol (methanol/ethanol). The additive composition is added to the alcohol-gasoline blends to improve low temperature stability, provides corrosion protection and to normalize vapor pressure of methanol/ethanol-gasoline blends.

15 Claims, No Drawings

ADDITIVE COMPOSITION FOR ENHANCED STABILITY OF OXYGENATED GASOLINE

FIELD OF THE INVENTION

The present invention relates to the development of an additive composition for alcohol-gasoline blends to improve low temperature stability, provide corrosion protection and reduce vapor pressure, and the process for production of the additive composition thereof. These stabilized alcohol-gasoline blends remain in single phase at low temperature and are useful as a fuel for automobiles. The additive composition is highly soluble in fuel and useful in forming better film for protection from corrosion and controls vapor pressure of alcohol (methanol/ethanol)-gasoline blends.

BACKGROUND OF THE INVENTION

With increasing concerns regarding environmental pollutants and reduction in the dependence on fossil fuel, there is more emphasis on the usage of oxygenated fuels namely E5, E20 (5 & 10% ethanol blended gasoline) and M3, M5, M10, M15 (3, 5, 10 & 15% methanol blended gasoline) also. Exposure of gasoline (E0)/alcohol-gasoline blends to ambient air, results in rapid evaporation of the most volatile fuel components. Under these conditions methanol-gasoline/ethanol-gasoline blends absorb moisture faster in humid environment than gasoline without alcohol (E0). The alcohol-gasoline blends having lower concentration of alcohol M3, M5, M10, E5, E10, etc., are more sensitive to moisture and tend to separate at low temperature and humid conditions. On the other hand, the higher ethanol-gasoline blends such as E15 or E20 have higher water tolerance and less vulnerable to phase separation.

Alcohol-gasoline blends are known to be used as motor fuel and use of such alcohol-gasoline blends provide advantages against atmospheric pollution with considerable reduction in the carbon monoxide content of exhaust gases of unleaded gasoline; hence a reduction in the exhaust gases emission. To be able to be used as a fuel, methanol-gasoline blends must be in a homogeneous single phase. However, in the presence of small quantities of water, oxygenated blends are not homogeneous at low temperature and separation into two phases is generally observed. To obtain homogeneous blends of methanol-gasoline at high altitude/at low temperature, therefore, it would be favorable to avoid the ingression of water, but in practice it is difficult to avoid ingression of moisture during the storage of methanol-gasoline blends or to improve their water tolerance levels.

U.S. patent application Ser. No. 4,336,032A by Produits Chimiques Ugine Kuhlmann, describes a process for stabilizing mixture of gasoline and methanol containing at least 30% by volume of methanol, wherein containing a primary, leaner, or branched chain monohydroxylated aliphatic saturated alcohol having 8 to 15 carbon number or mixture of alcohols, is added to the gasoline/methanol mixture.

U.S. Pat. No. 9,447,342B2 by Lubrizol Corp, relates to a fuel additive package for a low-sulfur diesel fuel comprising fatty acid (25-50% by weight), compatibilizer mixture (3-8% by weight) and an aromatic solvent. The fatty acid has a monounsaturated fatty acid content of less than 45% by weight and the compatibilizer mixture comprises a mixture of 1 to 10 carbon atom alcohol. Further, the additive composition has kinematic viscosity of less than 100 $mm^2/s$ at −29° C. and can be kept homogenous at this low temperature.

WO Publication No. 2000036055A1 by AAE Holdings Plc, discloses a method of reducing the vapor pressure (RVP) of a gasoline/alcohol mixture which comprises adding a surfactant composition comprising an alkanol amide, an alkoxylated alcohol and an alkoxylated fatty acid to a gasoline/alcohol mixture. CA patent application Ser. No. 2,355,265A1 and U.S. Pat. No. 6,786,939B2 by AAE Technologies International PLC, also describe a method of reducing the vapor pressure or Reid Vapor Pressure (RVP) of a gasoline/alcohol mixture which comprises adding a surfactant composition comprising an alkanol amide, an alkoxylated alcohol and an alkoxylated fatty acid to a gasoline/alcohol mixture.

M. Amine et al. studied the effect of ethyl acetate addition on formulated blends of ethanol-gasoline like E5, E10, E15, E20 and gasoline (E0). The study revealed that addition of ethyl acetate to ethanol-gasoline blends has many advantages such as enhancing the stability of the fuel blends and improving octane number with no adverse impacts on the volatility criteria of the investigated fuel blends (*Egyptian Journal of Petroleum* 27 (2018) 1333-1336).

Ying Tang et al. relates to the synthesis and use of hydroxy acetic acid esters (glycolic esters) as phase stabilizer and saturation vapor pressure depressor of methanol-gasoline blend. The results show that the stabilities of the blends depend on the length of the glycolic esters' alkoxy group. It is found that only glycolic esters with moderate carbon atoms provide effective phase stability to methanol-gasoline blend. The esters with alkoxy groups of 5-8 carbon atoms are more effective than others, with a dosage of only 0.1% (*Asian Journal of Chemistry,* Vol. 25, No. 15 (2013) 8447-8450).

Babazadeh Shayan et al. reviews the effect of oxygenate additives into gasoline for the improvement of physicochemical properties of blends. The addition of oxygenates lead to a distortion of the base gasoline's distillation curves. The Reid vapor pressure (RVP) of gasoline is found to increase with the addition of the oxygenated compounds. All oxygenates improve both motor and research octane numbers. Among the additives, tertiary butyl alcohol (TBA) shows the best fuel properties (*Chinese Journal of Mechanical Engineering* 25 (2012) 792-797).

Alcohol-gasoline blends absorb moisture from ambient air during their product handling, transportation, storage, etc. The extent of moisture absorption/accumulation depends upon alcohol concentration and type alcohol (C1, C2, C3, . . . etc.) in the alcohol-gasoline blends. In corrosion process, water/moisture tends to hydrolyze other materials, acts as an electrolyte, and thus creates acidic conditions which comes in contact with metallic surfaces. For this, appropriate corrosion inhibitor is needed for providing essential protection against metallic corrosion. There are products reported in the literature as corrosion inhibitors which are based on amide, imidazolines, pyridinium salt, mixture of amine salt of fatty acid, etc.

From the referred prior arts, it can be seen that attempts have been made to stabilize C1 and C2 alcohol-gasoline blends in the presence of low level of moisture conditions i.e., to avoid the oxygenated gasoline separation into phases at low temperature. However, there is no literature reference of a single package to address moisture tolerance, vapor pressure and corrosion protection for oxygenated gasoline. Therefore, it is desirable to have a novel additive composition which addresses the above-mentioned plethora of issues.

SUMMARY OF THE INVENTION

The present invention describes development of additive package comprising of a mixture of (a) 6-10% by weight of fatty acid (b) 7-15% by weight of alkoxy ether and (c) 60-85% by weight of linear or branched chain monohydroxylated aliphatic saturated alcohol (C2-C8) for improving stability of mixtures of methanol-gasoline, ethanol-gasoline blends containing at least 5-15% by volume of short chain alkanol (methanol/ethanol). The additive composition is added to the alcohol-gasoline blends to improve low temperature stability, provides corrosion protection and to normalize vapor pressure of methanol/ethanol-gasoline blends. The stabilized methanol-gasoline blends remain in single phase at low temperature and methanol-gasoline blends meeting the Indian Standard specification described herein are useful as a fuel for automobiles.

TECHNICAL ADVANTAGES OF THE INVENTION

The present invention has the following advantages over the cited prior arts:

i. Novel additive composition to stabilize C1 and C2 alcohol-gasoline blends in the presence of low level of moisture conditions, i.e., to avoid the oxygenated gasoline separation into phases at low temperature
ii. Additive composition is highly soluble in fuel, controls enhanced vapor pressure of methanol/ethanol-gasoline blends and provides protection from corrosion
iii. Additive composition doped methanol/ethanol-gasoline blends provides corrosion protection when additized fuel comes in contact with metallic surfaces
iv. Single additive package for alcohol blended gasoline and easy to scale up
v. Additive package can be used as such without further processing
vi. Optimized additive package is cost effective and high performing, based on indigenous components
vii. Process to produce developed additive package is simple and easy to scale up
viii. It is a single step reaction process to produce the additive package from fatty acid (C14-C20), alkoxy ether (C3-C5) and linear or branched chain monohydroxylated aliphatic saturated alcohol (C3-C6)
ix. Product is highly effective to prevent the methanol/ethanol-gasoline separation into phases, controls vapor pressure of methanol/ethanol-gasoline blends and corrosion protection when additized fuel comes in contact with metallic surfaces

OBJECTIVES OF THE PRESENT INVENTION

It is a primary objective of the present invention to develop suitable additive system to stabilize alcohol-gasoline blends such as methanol-gasoline and ethanol-gasoline blends at low temperature (<−10° C.) in the presence of small quantities of water and to avoid phase separation by adding additive package. The additive composition is highly soluble in fuel and useful in forming better film for protection from corrosion and also controls vapor pressure of methanol/ethanol-gasoline blends.

It is also an objective of the present invention to develop petroleum fuel soluble additive composition to stabilize oxygenated gasoline bends at low temperature in the presence of minute quantities of water i.e., to avoid the methanol-gasoline separation into phases, control vapor pressure of methanol/ethanol-gasoline blends and provide corrosion protection as per the fuel standard specifications. The developed composition consists of a synergistic mixture of fatty acid, alkoxy ether (C4-C5) and linear or branched chain monohydroxylated aliphatic saturated alcohol.

DETAILED DESCRIPTION OF THE INVENTION

Those skilled in the art will be aware that the present disclosure is subject to variations and modifications other than those specifically described. It is to be understood that the present disclosure includes all such variations and modifications. The disclosure also includes all such steps of the process, features of the system, referred to or indicated in this specification, individually or collectively, and any and all combinations of any or more of such steps or features.

Definitions

For convenience, before further description of the present disclosure, certain terms employed in the specification, and examples are collected here. These definitions should be read in the light of the remainder of the disclosure and understood as by a person of skill in the art. The terms used herein have their meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The terms "comprise" and "comprising" are used in the inclusive, open sense, meaning that additional elements may be included. It is not intended to be construed as "consists of only".

Throughout this specification, unless the context requires otherwise the word "comprise", and variations such as "comprises" and "comprising", will be understood to imply the inclusion of a stated element or step or group of element or steps but not the exclusion of any other element or step or group of element or steps.

The term "including" is used to mean "including but not limited to". "Including" and "including but not limited to" are used interchangeably.

Unless defined otherwise, all technical and scientific terms used herein have the same meaning as commonly understood by one of ordinary skill in the art to which this disclosure belongs. Although any methods and materials similar or equivalent to those described herein can be used in the practice or testing of the disclosure, the preferred methods, and materials are now described. All publications mentioned herein are incorporated herein by reference.

The present disclosure is not to be limited in scope by the specific embodiments described herein, which are intended for the purposes of exemplification only. Functionally equivalent products and methods are clearly within the scope of the disclosure, as described herein.

The present invention provides a process to develop petroleum fuel soluble additive composition to stabilize methanol-gasoline bends (M3, M5, M10, M15, etc.) and ethanol-gasoline blends (E5, E10) at low temperature in the presence of low quantities of water (beyond the moisture tolerance of alcohol-gasoline at low temperature), i.e., to avoid the separation of methanol-gasoline/ethanol-gasoline blends into phases, controls vapor pressure of methanol/ethanol-gasoline blends and provide corrosion protect. The developed composition consists of a mixture of fatty acid, alkoxy ether (C3-C5) and linear or branched chain monohydroxylated aliphatic saturated alcohol.

In another embodiment, the developed additive composition is the blend of fatty acid, alkoxy ether and linear or branched chain monohydroxylated aliphatic saturated alcohol which dissolve well in alcohol blended gasoline especially methanol-gasoline/ethanol gasoline blends. The proposed additive composition enhances the dispersibility/solubility of lower alcohols like methanol and ethanol in hydrocarbon phase, lowers/reduces the vapor pressure (or RVP) of methanol-gasoline/ethanol gasoline blends, provides moisture tolerance and phase stability at low temperature. Additionally, additive composition forms protective film over the metal surfaces and provides better corrosion protection.

In yet another embodiment, the additive composition for alcohol-gasoline blend comprises a synergistic mixture of: (a) 1-10% by weight of a fatty acid; (b) 1-15% by weight of an alkoxy ether; and (c) 50-85% by weight of a monohydroxylated aliphatic saturated alcohol, based on the total weight of the additive composition. Further the monohydroxylated aliphatic saturated alcohol comprises a linear or branched chain alcohol.

In another preferred embodiment, the fatty acid comprises 14 to 20 carbon atoms, the alkoxy ether comprises 3 to 5 carbon atoms, and the monohydroxylated aliphatic saturated alcohol comprises 3 to 6 carbon atoms.

In an embodiment of the invention, the alcohol-gasoline blend comprises at least 5-15% by volume of short chain alkanol. The alkanol is selected from a group consisting of methanol and ethanol.

In yet another embodiment, the additive system is capable of stabilizing alcohol-gasoline blends such as methanol-gasoline and ethanol-gasoline blends at low temperature (<−10° C.) in the presence of small quantities of water and also avoids phase separation.

In an embodiment, the present inventio discloses an alcohol-gasoline blend composition comprising: (a) 0.25-5% by volume of an additive; (b) 15% by volume of methanol; and (c) 5-10% by volume of ethanol, based on the total volume of the fuel.

The chemical compounds use in the present invention are explained below:

Alkoxy Ether

Alkoxy ether (C3-C5) has better miscibility with gasoline fuel/alcohols/alcohol-gasoline blends and low affinity water. It provides good moisture tolerance for aliphatic and aromatic hydrocarbons. These characteristics of alkoxy ether can be used for alcohol-gasoline blends especially methanol-gasoline blends. Alkoxy ether in combination higher alcohol (C3-C5) forms a complex which enhances film formation over the surface and controls or reduces vapor pressure of blended fuel.

Fatty Acid

The fatty acid of any fatty acid or mixture of fatty acids having alkyl chain of 14-20 carbon atoms. Common examples are palmitic, linoleic, linolenic, stearic and ricinoleic acid, etc.

Aliphatic Saturated Alcohol

The monohydroxylated saturated alcohols, linear or branched chain of range C3 to C6 were used to prepare additive composition for providing moisture tolerance, phase stability at low temperature, and form protective film over the metal surfaces and provides better corrosion protection for alcohol-gasoline blends.

The additive composition at variable treat rate (0.25%-5%, v/v) has been blended in alcohol (methanol/ethanol) blended gasoline having methanol concentration of 15% by volume and ethanol concentration of 5 and 10% by volume.

Typical Reaction Procedure

A typical additive composition comprises of (a) 6.25 wt. % of fatty acid, (b) 12.5 wt. % of alkoxy ether and (c) 81.25 wt. % of linear or branched chain monohydroxylated aliphatic saturated alcohol. After complete mixing of all components at room temperature, reaction mixture was stirred for about 30 minutes.

EXAMPLES

Having described the basic aspects of the present invention, the following non-limiting examples illustrate specific embodiment thereof. Those skilled in the art will appreciate that many modifications may be made in the invention without changing the essence of invention. The process of present invention is exemplified by the following non-limiting examples.

Example 1

The additive composition consists of 100% by weight of fatty acid for methanol-gasoline/ethanol-gasoline blends containing at least 15% by volume of methanol/ethanol. The prepared additive composition was added at variable treat rates the blends of methanol-gasoline/ethanol-gasoline blends.

Example 2

The additive composition consists of 100% by weight of alkoxy ether for mixtures of methanol-gasoline/ethanol-gasoline blends containing at least 15% by volume of methanol/ethanol. The prepared additive composition was added at variable treat rates to the blends of methanol-gasoline/ethanol-gasoline blends.

Example 3

The additive composition was prepared using 100% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 4

The additive composition was prepared by blending of (a) 25% by weight of fatty acid and (b) 75% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 5

The additive composition was prepared by blending of (a) 25% by weight of alkoxy ether and (5) 75% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 6

The additive composition was prepared by blending of (a) 1% by weight of fatty acid (b) 1% by weight of alkoxy ether and (c) 98% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 7

The additive composition was prepared by blending of (a) 5% by weight of fatty acid (b) 10% by weight of alkoxy ether and (c) 85% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 8

The additive composition was prepared by blending of (a) 7% by weight of fatty acid (b) 8% by weight of alkoxy ether and (c) 85% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 9

The additive composition was prepared by blending of (a) 10% by weight of fatty acid (b) 10% by weight of alkoxy ether and (c) 80% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 10

The additive composition was prepared by blending of (a) 10% by weight of fatty acid (b) 20% by weight of alkoxy ether and (c) 70% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 11

The additive composition was prepared by blending of (a) 10% by weight of fatty acid (b) 30% by weight of alkoxy ether and (c) 60% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 12

The additive composition was prepared by blending of (a) 6% by weight of fatty acid (b) 9% by weight of alkoxy ether and (c) 85% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 13

The additive composition was prepared by blending of (a) 20% by weight of fatty acid (b) 5% by weight of alkoxy ether and (c) 75% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 14

The additive composition was prepared by blending of (a) 6% by weight of fatty acid (b) 10% by weight of alkoxy ether and (c) 84% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 15

The additive composition was prepared by blending of (a) 6% by weight of fatty acid (b) 15% by weight of alkoxy ether and (c) 79% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 16

The additive composition was prepared by blending of (a) 8% by weight of fatty acid (b) 10% by weight of alkoxy ether and (c) 82% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 17

The additive composition was prepared by blending of (a) 10% by weight of fatty acid (b) 25% by weight of alkoxy ether and (c) 65% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Example 18

The additive composition was prepared by blending of (a) 10% by weight of fatty acid (b) 25% by weight of alkoxy ether and (c) 65% by weight of linear or branched chain monohydroxylated aliphatic saturated alcohol. The prepared additive composition was added at variable treat rates to the blends of methanol-gasoline/ethanol-gasoline containing at least 15% by volume of methanol/ethanol.

Performance Evaluation of Additive

Following three tests were used for measuring the efficacy of additive package for low temperature phase stability, vapor pressure and NACE corrosion by doping additive package in methanol-gasoline/ethanol-gasoline blends.

A. Low Temperature Phase Stability Evaluation

The phase stability of methanol-gasoline/ethanol-gasoline blends was determined by the test procedure mentioned under Annex B of IS 17076: 2019 (M15 fuel Specification) IS 2796: 2017 (Motor-gasoline specification).

Test Method for Water Tolerance (Phase Separation) of Gasoline-Alcohol Blends

This test method determines the ability of gasoline stable oxygenate blends to retain water in solution or in a stable suspension at the lowest temperature to which they are likely to be exposed in use.

Summary of Test Method and Use

A sample of the fuel is cooled at a controlled rate to its expected use temperature and is periodically observed for both haze and phase separation. The apparatus as given in 4 of IS 1448 [P:10] or a dry ice-isopropyl alcohol both may be used. A maximum cooling rate of 2° C./mm is specified because phase separation in gasoline-oxygenate blends has a relatively long but unpredictable induction period.

Some oxygenate-containing fuels and gasoline alcohol blends have a very limited ability to retain water in solution or in stable suspension. If the amount of water in the blend exceeds this limit, the fuel will separate into a lower oxygenate-rich aqueous phase and an upper oxygenate-lean hydrocarbon phase. The most important factor governing the ability of a specific fuel to retain water without such separation is its temperature. This method is intended to determine the maximum temperature at which the fuel will separate. The temperature represents the maximum temperature above which the fuel must not separate into two distinct phases.

Note that in this test actual separation of the sample into two distinct phases is the criterion for failure. The following are indication of phase separation.

The formation of droplets large enough to be detected by the unaided eye. They may be either clinging to sides of the container or collect on the bottom.

The formation of two layers separated by either a common boundary, or a layer of emulsion. Formation of haze without one of this indication of separation is not cause for rejection.

Test Container

Any glass container of about 100 ml capacity may be used. This container may be marked at the level of 40 ml.

Thermometer

A thermometer must be provided for each container, mounted to pass through the stopper, with the requirements as follows:

a) Range: 80 to ±20° C.

b) Graduation 1° C. and c) Immersion 76 mm

Viton Rubber Stopper

To fit sample container bored centrally for the test thermometer.

Cooling Bath

May be of similar dimension to those specified in 4 of IS 1448 [P:10] and provided with a jacket disk and gasket (as specified in the apparatus section) filled with an equal-volume mixture of water and permanent antifreeze and provided with refrigeration coils capable of reducing its temperature to −40° C. Alternatively, a dry ice-isopropyl alcohol bath may be used.

Sampling and Handling

Draw samples in accordance with IS 1447 (part 1), except water displacement shall not be used. Draw the samples in steel cans that have been solvent washed. Store the samples in refrigerator (2 to 7° C.) wherever not actually transferring sample. Because gasoline-alcohol blends are hygroscopic as well as volatile. Minimize contact with the atmosphere by keeping sample containers tightly closed except when transferring sample.

Test Procedure

Warm the sample to 15° C. and shake, to re-dissolve any water that may have settled out at the refrigerator temperature.

Cool the test container to 10 to 15° C., rinse the cooled test container with some of the sample to be tested and drain. Carry out this step as promptly as possible to minimize vaporization losses and absorption of water from the atmosphere.

Pour about 40 ml of the sample into the test container. The precise amount is not critical, but it must be enough to submerge the thermometer bulb adequately, without being so much as to require an excessive amount of cooling time. If the sample has separated, terminate the test.

Seal the test container with the rubber stopper. Locate the thermometer bulb approximately at the center of the fuel sample.

Cool the sample by intermittent immersion in or circulation of the coolant. The sample is not to be swirled or shaken while in the cooling bath. Starting at a cooling bath temperature not higher than 10° C. or 16° C. above the test temperature, Cool the sample at a maximum rate of 2° C./min until phase separation occurs or the test temperature is reached.

At 2° C. intervals, remove the test container from the cooling bath and shake vigorously for 5 to 10 s. Wipe the exterior of the sample container with a towel moistened with isopropyl alcohol to remove any condensation, and observe the condition of the sample for no more than 5 s against a light-colored illuminated background.

It is likely that the sample will get hazy prior to actual phase separation. Record the sample temperature at the first indication of the haze (when cooling: and the temperature when the haze disappears (warning).

Record the temperature of the phase separation. Then allow the sample to warm at ambient temperature rise of 2° C. and observe. Record a 'warning' phase recombination temperature. And the haze disappearance temperature. Average these 'cooling' and 'warning' temperature to determine the actual phase separation and haze point temperatures. Repeat this process for improved accuracy.

Report

Report the following information.

Report the averaged haze point and phase separation temperatures found.

The results of water tolerance (phase separation) and water content of alcohol-gasoline blends are given below in Table 1.

TABLE 1

Results of water tolerance (phase separation) and water content of alcohol-gasoline blends

| S. No. | Sample | Moisture tolerance (ppmW) at −10° C. | Phase Separation temperature, ° C. as per Annex B of IS 17076 & IS2796 |
|---|---|---|---|
| 1 | Gasoline | | Not applicable |
| 2 | M15 gasoline | 350 | Phase separation at +3° C. |
| 3 | M15 with 1200 ppm moisture + Example 1 @0.25 to 3.0%, v/v | — | Phase separation at +2° C. |
| 4 | M15 with 1200 ppm moisture + Example 2 @0.25 to 3.0%, v/v | 450 | Phase separation at −1° C. to −5° C. |

TABLE 1-continued

Results of water tolerance (phase separation) and water content of alcohol-gasoline blends

| S. No. | Sample | Moisture tolerance (ppmW) at −10° C. | Phase Separation temperature, ° C. as per Annex B of IS 17076 & IS2796 |
|---|---|---|---|
| 5 | M15 with 1200 to 2000 ppm moisure + Example 3 @1, 2, 3 & 5%, v/v | 800 | Phase separation at −5, −8, −15 & −20° C., respectively |
| 6 | M15 gasoline + Example 4 @2%, v/v | 1000 | Phase separation at −8° C. |
| | M15 gasoline + Example 4 @3%, v/v | 1200 | Phase separation at −15° C. |
| | M15 gasoline + Example 4 @5%, v/v | 2000 | Phase separation at −20° C. |
| 7 | M15 gasoline + Example 5 @3%, v/v | 1400 | Phase separation at −15° C. |
| | M15 gasoline + Example 5 @5%, v/v | 2300 | Phase separation at −15° C. |
| 8 | M15 gasoline + Example 6 @3%, v/v | 1500 | Phase separation at −15° C. |
| 9 | M15 gasoline + Example 7 @3%, v/v | 1600 | Phase separation at −15° C. |
| 10 | M15 gasoline + Example 8 @3%, v/v | 1600 | Phase separation at −15° C. |
| 11 | M15 gasoline + Example 7 @3%, v/v | 1700 | Phase separation at −15° C. |
| 12 | M15 gasoline + Example 10 @3%, v/v | 1700 | Phase separation at −15° C. |
| 13 | M15 gasoline + Example 11 @3%, v/v | 2000 | Phase separation at −15° C. |
| 14 | M15 gasoline + Example 12 @3%, v/v | 1900 | Phase separation at −15° C. |
| 15 | M15 gasoline + Example 13 @3%, v/v | 1500 | Phase separation at −15° C. |
| 16 | M15 gasoline + Example 14 @3%, v/v | 1300 | Phase separation at −15° C. |
| 17 | M15 gasoline + Example 15 @3%, v/v | 1700 | Phase separation at −15° C. |
| 18 | M15 gasoline + Example 16 @3%, v/v | 2000 | Phase separation at −15° C. |
| 19 | M15 gasoline + Example 17 @3%, v/v | 1900 | Phase separation at −15° C. |
| 20 | E5 gasoline | 1400 | Phase separation at −15° C. |
| 21 | E10 gasoline | 3600 | Phase separation at −15° C. |
| 22 | A20 gasoline | 1400 | Phase separation at −15° C. |
| 23 | E5 gasoline + Example 17 @2%, v/v | 2000 | Phase separation at −15° C. |
| 24 | E10 gasoline + Example 17 @2%, v/v | 4200 | Phase separation at −15° C. |
| 25 | A20 gasoline + Example 17 @2%, v/v | 2500 | Phase separation at −15° C. |

As demonstrated in Table 1, the additive composition of the present invention exhibiting significant moisture tolerance and phase stability in methanol-gasoline blends as compared to the methanol-gasoline blend without the additive. Gasoline blend having 15% methanol can tolerate only 350 ppm moisture at −10° C. As the methanol-gasoline blend exposes to more moisture, phase separation take place even at higher temperature. Fatty acid and aloxy ether alone as in "Example 1" and "Example 2" itself did not provide sufficient moisture tolerance to stabilize the methanol-gasoline blends. But addition of saturated alcohol alone as in "Example 3" did provide enhanced moisture tolerance to lowers temperature and to stabilize the methanol-gasoline blends at stated temperature. To further enhance the moisture tolerance and phase stabilize the methanol-gasoline blends, combinations of fatty acid, alkoxy ether and saturated alcohol were tried as in Example 4 to Example 17. The additive composition as shown in Example 4 to Example 17 did provide significant moisture tolerance at −15° C. i.e., up to 2000, 4200 & 2500 ppm and stabilized phase at lower temperature of methanol-gasoline blends (M15), ethanol-gasoline blends (E5, E10) and methanol-ethanol-gasoline blends (A20 gasoline), respectively.

B. Vapor Pressure Evaluation

Vapor pressure is a very important physical property of volatile liquids. The vapor pressure of gasoline and gasoline-oxygenate blends is regulated by various government agencies. Specifications for volatile petroleum products generally include vapor pressure limits to ensure products of suitable volatility performance.

As specified in Indian fuel specifications, IS 17076: 2019 (M15 fuel Specification) IS 2796: 2017 (Motor-gasoline specification), test method ASTM D5191-2019 was used to measure the vapor pressure of alcohol-gasoline blends. The test method covers the use of automated vapor pressure instruments to determine the total vapor pressure exerted in vacuum by air-containing, volatile, liquid petroleum products, and liquid fuels, including automotive spark-ignition fuels with or without oxygenates and with ethanol blends up to 85% (volume fraction).

Test Conditions

A known volume of chilled, air-saturated sample is introduced into a thermostatically controlled, evacuated test chamber that expands the volume after sample introduction, the internal volume of which is five times that of the total test specimen introduced into the chamber. After introduction into the test chamber, the test specimen is allowed to reach thermal equilibrium at the test temperature, 37.8° C. (100° F.). The resulting rise in pressure in the chamber is measured using a pressure transducer sensor and indicator. Only total pressure measurements (sum of the partial pressure of the sample and the partial pressure of the dissolved air) are used in this test method, although some instruments can measure the absolute pressure of the sample as well.

The measured total vapor pressure is converted to a dry vapor pressure equivalent (DVPE) by use of a correlation equation.

Test Procedure

Take out the sample from the cooling bath or refrigerator, dry the exterior of the container with absorbent material, uncap, and insert a transfer tube or chilled syringe. Draw a bubble-free aliquot of sample into a gas tight syringe or transfer tube and deliver this test specimen to the test chamber as rapidly as possible. The total time between opening the chilled sample container and inserting/securing the syringe into the sealed test chamber shall not exceed 1 min. Follow the manufacturer's instructions for introduction of the test specimen into the test chamber, and for operation of the instrument to obtain a total vapor pressure result for the test specimen. Set the instrument to read the result in terms of total vapor pressure.

Calculation

Record the total vapor pressure reading from the instrument to the nearest 0.1 kPa (0.01 psi). For instruments that do not automatically record a stable pressure value, manually record the pressure indicator reading every minute to the nearest 0.1 kPa. When three successive readings agree to within 0.1 kPa, record the result to the nearest 0.1 kPa (0.01 psi).

Calculate the DVPE using Equation (1). Ensure that the instrument reading used in this equation corresponds to the total pressure and has not been corrected by an automatically programmed correction factor:

$$\text{DVPE, kPa(psi)} = (0.965X) - A \quad (1)$$

where X=measured total vapor pressure in kPa (psi), and A=3.78 kPa (or 0.548 psi).

The calculation described by Equation 1 can be accomplished automatically by the instrument, if so equipped, and in such cases the user shall not apply any further corrections.

Report

Report the DVPE value to the nearest 0.1 kPa (0.01 psi) without reference to temperature, along with the volume container size (250 mL or 1 L) in which the result was obtained.

TABLE 2

Results of Reid vapor pressure of alcohol-gasoline blends

| S. No. | Sample | Reid Vapour Pressure, RVP (kPa) |
|---|---|---|
| 1 | Gasoline | 52 |
| 2 | M15 gasoline | 75 |
| 3 | M15 gasoline + Example 1 @0.25%, v/v | 74.5 |
| | M15 gasoline + Example 1 @0.5%, v/v | 75 |
| | M15 gasoline + Example 1 @1%, v/v | 75 |
| | M15 gasoline + Example 1 @3%, v/v | 74.5 |
| 4 | M15 gasoline + Example 2 @0.25%, v/v | 74.5 |
| | M15 gasoline + Example 2 @0.5%, v/v | 74.5 |
| | M15 gasoline + Example 2 @1%, v/v | 73.5 |
| | M15 gasoline + Example 2 @2%, v/v | 73.0 |
| | M15 gasoline + Example 2 @3%, v/v | 72.0 |
| 5 | M15 gasoline + Example 3 @1%, v/v | 73.5 |
| | M15 gasoline + Example 3 @2%, v/v | 73.0 |
| | M15 gasoline + Example 3 @3%, v/v | 72.5 |
| | M15 gasoline + Example 3 @5%, v/v | 72.0 |
| 6 | M15 gasoline + Example 4 @2%, v/v | 73.0 |
| | M15 gasoline + Example 4 @3%, v/v | 73.0 |
| | M15 gasoline + Example 4 @5%, v/v | 72.5 |
| 7 | M15 gasoline + Example 5 @1%, v/v | 72.0 |
| | M15 gasoline + Example 5 @2%, v/v | 71.0 |
| | M15 gasoline + Example 5 @3%, v/v | 70.0 |
| | M15 gasoline + Example 5 @5%, v/v | 69.5 |
| 8 | M15 gasoline + Example 6 @3%, v/v | 73.5 |
| 9 | M15 gasoline + Example 7 @3%, v/v | 72.5 |
| 10 | M15 gasoline + Example 8 @3%, v/v | 71.5 |
| 11 | M15 gasoline + Example 9 @3%, v/v | 71.0 |
| 12 | M15 gasoline + Example 10 @3%, v/v | 70.0 |
| 13 | M15 gasoline + Example 11 @3%, v/v | 69.0 |
| 14 | M15 gasoline + Example 12 @3%, v/v | 68.0 |
| 15 | M15 gasoline + Example 13 @3%, v/v | 69.5 |
| 16 | M15 gasoline + Example 14 @3%, v/v | 72.5 |
| 17 | M15 gasoline + Example 15 @3%, v/v | 69.5 |
| 18 | M15 gasoline + Example 16 @3%, v/v | 70.5 |
| 19 | M15 gasoline + Example 17 @3%, v/v | 68.5 |
| 20 | E5 gasoline | 61 |
| 21 | E5 gasoline + Example 17 @3%, v/v | 56.5 |
| 22 | E10 gasoline | 63 |
| 23 | E10 gasoline + Example 17 @3%, v/v | 57.0 |
| 24 | A20 gasoline | 73.5 |
| 25 | A20 gasoline + Example 17 @3%, v/v | 68.5 |

As demonstrated in Table 2, the invented additive composition has displayed significant reduction in RVP by 3-7 units of methanol-gasoline blends as compared to the methanol-gasoline blend without the additive. The efficacy of the additive composition for trimming down RVP of methanol-gasoline blends was demonstrated in Table 2. Gasoline blend having 15% methanol showed RVP 75 Kpa without any additive. Fatty acid and alkoxy ether alone as in "Example 1", "Example 2" and "Example 3" itself did not cut down the RVP sufficiently even sat higher dosages. The optimized formulations of Fatty acid, alkoxy ether and saturated alcohol as shown in "Example 7", "Example 13", "Example 14, "Example 15" to "Example 17 have significantly reduced the vapor pressure (RVP) of methanol-gasoline blends (M15), ethanol-gasoline blends (E5, E10) and methanol-ethanol-gasoline blends (A20 gasoline) by cutting down RVP by 5-7 units to meet Indian Standards (IS 2796, IS 17076) requirements for E5/E10 gasoline, M15 and A210 gasoline.

C. NACE Corrosion Evaluation

An internationally accepted test method NACE TM0172 for evaluating performance of corrosion inhibitor component of additive package in additized methanol-gasoline/ethanol-gasoline blends.

The test provides a procedure for conducting at test to determine the corrosive properties of gasoline and distillate fuels in preparation for transport through a pipeline. Also included is information on test specimen preparation, equipment, and a system for rating the test specimens. In this test method, the surface of a cylindrical steel test specimen is prepared and then immersed in a mixture of the test fuel and distilled water. The mixture is stirred and is maintained at a prescribed temperature. The test specimen is then rated by the proportion of test surface that has corroded. Experience has shown that if enough inhibitor is present to produce B+ or better results as defined in this standard, general corrosion in flowing pipelines may be controlled.

This test method does not predict corrosiveness in the standing aqueous phase, nor does it predict microbiological attack.

Test Apparatus

Test apparatus/set up should be as per NACE Corrosion TM0172/ASTM D665 test apparatus Test Fuel The test fuel consists of methanol-gasoline/ethanol-gasoline blends with and with additive package.

Test Spindles/Carbon Steel Spindles Specimens

Dimensions and quality of Carbon Steel Spindles used in the test as specified in standard Corrosion test method NACE TM 0172-2001. The test specimen should be made of steel conforming to UNS (2) G10150 (Grade 1015), UNS G10180 (1018), UNS G10200 (1020), or UNS G10250 (1025) of ASTM A 108. The surface of spindles shall be polished, and surface finish shall be with 300 emery grit, free from pits & scratches.

Test Beaker

A modified, 400 mL, Berzelius-type glass beaker that is heat resistant and does not have a pour spout shall be used. It should be approximately 127 mm (5.00 in.) high when measured inside the beaker at the center of the base. The inside diameter should be approximately 71 mm (2.8 in.).

Test Fuel Quantity: 300 ml per test

Distilled Water Quantity: 30 ml per test

Test Temperature: 38±1° C.

Pressure: Atmospheric

Stirring Speed: 1000±50 rpm

Test Duration: 4 hrs

Test Procedure

The following procedures shall be used to conduct the test:

- Clean the beaker and glass beaker cover with an approved cleaning solution, wash thoroughly with distilled water to remove the cleaning solution completely, and then dry in an oven.
- Clean the stainless-steel stirrer and polymethyl methacrylate cover using ASTM precipitation naphtha or isooctane. Wash thoroughly with hot water and finally with distilled water, and then dry at a temperature not exceeding 65° C. (150° F.), such as in an oven.
- Pour 300 mL (10.1 oz fluid) of the fuel to be tested into the beaker and place the beaker in the oil bath, which should be maintained at a temperature that keeps the fuel sample at 38±1° C. (100±2° F.).
- The oil level in the bath shall not be below the fuel level in the test beaker. Cover the beaker with the beaker cover after placing the stirrer in the proper opening;

then rotate the beaker so that the baffles are 90 degrees from the test specimen hole.

Adjust the stirrer so that the shaft is 6.1 mm (0.24 in.) off center in the beaker containing the fuel sample and the blade is within 2 mm (0.09 in.) of the bottom of the beaker.

Suspend the temperature-measuring device through the hole intended for that purpose so that it is immersed to a depth of 56 mm (2.2 in.).

Start the stirrer, and when the temperature of the fuel sample reaches 38±1° C. (100±2° F.), insert the steel test specimen prepared in accordance with Section 2 of NACE TM0172.

Insert the test specimen assembly through then test specimen hole in the beaker cover and suspend it such that its lower end is 13 to 15 mm (0.51 to 0.59 in.) from the bottom of the beaker.

Stir at 1,000±50 rpm for 30 minutes to ensure complete wetting of the steel test specimen. With the stirrer in motion, remove the temperature-measuring device temporarily and add 30 mL (1.0 oz fluid) of distilled water through this hole, discharging the water onto the bottom of the beaker. This can be accomplished by injecting the water with a syringe through a needle or by pouring through a long-necked funnel. Then replace the temperature measuring device or, alternatively, stopper the hole.

Continue stirring at a speed of 1,000±50 rpm for 3.5 hours from the time the water was added, maintaining the temperature of the fuel-water mixture at 38±1° C. (100±2° F.).

Stop the stirring at the end of the 3.5-hour period. Remove the test specimen, allow it to drain, and then wash it with toluene or xylene followed by acetone.

Rating of Test Specimen

Test specimens shall be rated as per test Table 3 given in NACE TM 0172 test method. Rating shall be based exclusively on the portion of the test specimen exposed within the test fluid. Corrosion products formed during the test have had limited opportunity to darken, and all deposition of solids not removed by washing with toluene and acetone shall be considered corrosion products.

TABLE 3

NACE TM 0172 test method

| Rating | Percent of Test Surface Corroded |
|---|---|
| A | 0 |
| B++ | Less than 0.1 (2 or 3 spots of no more than 1-mm [0.04-in.] diameter) |
| B+ | Less than 5 |
| B | 5 to 25 |
| C | 25 to 50 |
| D | 50 to 75 |
| E | 75 to 100 |

The results of NACE corrosion test of alcohol-gasoline blends are given below in Table 4.

TABLE 4

Results of NACE corrosion test of alcohol-gasoline blends

| S. No. | Sample | NACE Corrosion rating |
|---|---|---|
| 1 | Gasoline | E |
| 2 | M15 gasoline | E |

TABLE 4-continued

Results of NACE corrosion test of alcohol-gasoline blends

| S. No. | Sample | NACE Corrosion rating |
|---|---|---|
| 3 | M15 gasoline + Example 1 @0.25, 0.5%, v/v | B |
| | M15 gasoline + Example 1 @1-3%, v/v | A |
| 4 | M15 gasoline + Example 2 @0.25 to 3%, v/v | C |
| 5 | M15 gasoline + Example 3 @1%, v/v | C |
| | M15 gasoline + Example 3 @2-5%, v/v | B |
| 6 | M15 gasoline + Example 4 @2-5%, v/v | A |
| 7 | M15 gasoline + Example 5 @1-5%, v/v | A |
| 8 | M15 gasoline + Example 6 @3%, v/v | A |
| 9 | M15 gasoline + Example 7 @3%, v/v | A |
| 10 | M15 gasoline + Example 8 @3%, v/v | A |
| 11 | M15 gasoline + Example 9 @3%, v/v | A |
| 12 | M15 gasoline + Example 10 @3%, v/v | A |
| 13 | M15 gasoline + Example 11 @3%, v/v | A |
| 14 | M15 gasoline + Example 12 @3%, v/v | A |
| 15 | M15 gasoline + Example 13 @3%, v/v | A |
| 16 | M15 gasoline + Example 14 @3%, v/v | A |
| 17 | M15 gasoline + Example 15 @3%, v/v | A |
| 18 | M15 gasoline + Example 16 @3%, v/v | A |
| 19 | M15 gasoline + Example 17 @3%, v/v | A |
| 20 | E5 gasoline | D |
| 21 | E5 gasoline + Example 17 @3%, v/v | A |
| 22 | E10 gasoline | D |
| 23 | E10 gasoline + Example 17 @3%, v/v | A |
| 24 | A20 gasoline | D |
| 25 | A20 gasoline + Example 17 @3%, v/v | A |

The invented additive composition had showed excellent performance in NACE corrosion test under acidic test conditions. The efficacy of the additive composition for providing corrosion protection to methanol-gasoline blends was demonstrated in Table 3. Gasoline and gasoline blended with 15% methanol have showed "E" rating without any additive. Fatty acid at higher treat rate as shown in "Example 1" did provide corrosion protection whereas alkoxy ether alone as in shown "Example 2" did not provide sufficient corrosion protection even at higher dosages to 15% methanol blended gasoline. The optimized formation of Fatty acid, alkoxy ether and saturated alcohol as shown in "Example 4" to "Example 17 have significantly improved the NACE corrosion rating to "A" as compared to base gasoline, base methanol-gasoline, ethanol-gasoline & A20 gasoline blends without additive.

We claim:

1. A composition consisting of:

an alcohol-gasoline blend consisting of 15% by volume of methanol, or 5-10% by volume of ethanol based on a total volume of the alcohol-gasoline blend; and an additive composition, wherein the additive composition consists of a synergistic mixture of:

(a) 1-10% by weight of a fatty acid;

(b) 1-15% by weight of an alkoxy ether; and (c) 50-85% by weight of a monohydroxylated aliphatic saturated alcohol, based on a total weight of the additive composition, wherein the additive composition is characterized to provide corrosion inhibition when the composition is in contact with metallic surfaces.

2. The composition as claimed in claim 1, wherein the fatty acid consists of 14 to 20 carbon atoms.

3. The composition as claimed in claim 1, wherein the alkoxy ether consists of 3 to 5 carbon atoms.

4. The composition as claimed in claim 1, wherein the monohydroxylated aliphatic saturated alcohol consists of 3 to 6 carbon atoms.

5. The composition as claimed in claim 4, wherein the monohydroxylated aliphatic saturated alcohol consists of a linear or branched chain alcohol.

6. The composition as claimed in claim 1, wherein the additive composition is characterized to stabilize the alcohol-gasoline blends at a temperature less than −10° C.

7. A process for preparation of a composition, the process consists of steps:

(a) mixing a fatty acid, an alkoxy ether and a monohydroxylated aliphatic saturated alcohol at an operating temperature to obtain a reaction mixture; and (b) stirring the reaction mixture, and (c) adding the reaction mixture to a blend of methanol-gasoline or ethanol-gasoline at variable treat rates.

8. The process as claimed in claim 7, wherein the operating temperature is room temperature.

9. The process as claimed in claim 7, wherein stirring the reaction mixture consists of stirring for a period of about 30 minutes.

10. The process as claimed in claim 7, wherein the process is a single step reaction process.

11. The process as claimed in claim 7, wherein mixing the fatty acid, the alkoxy ether and the monohydroxylated aliphatic saturated alcohol consists of mixing 1-10% by weight of the fatty acid, 1-15% by weight of the alkoxy ether, and 50-85% by weight of the monohydroxylated aliphatic saturated alcohol, based on a total weight of the additive composition.

12. The process as claimed in claim 7, wherein adding the reaction mixture to the blend of methanol-gasoline or ethanol-gasoline at variable treat rates consists of adding at treat rates in a range of 0.25%-5% v/v.

13. The composition as claimed in claim 1, wherein the composition has a moisture tolerance in a range of 2000-4200 ppm at −15° C., and wherein alcohol-gasoline blends without the additive composition have a moisture tolerance in a range of 350-1200 ppm.

14. The composition as claimed in claim 1, wherein the composition has 3-7 units of reduced vapor pressure (RVP) as compared to an alcohol-gasoline blend without the additive composition.

15. The composition as claimed in claim 1, wherein the composition has a NACE (National Association of Corrosion Engineers) corrosion rating of A as compared to an alcohol-gasoline blend without the additive composition, wherein rating of A is an indication of zero percent of a test surface corroded.

* * * * *